US006722538B1

(12) United States Patent
Autry et al.

(10) Patent No.: US 6,722,538 B1
(45) Date of Patent: Apr. 20, 2004

(54) ADJUSTABLE CLOTHES HANGER

(76) Inventors: Hayward Autry, P.O. Box 623, Denver, NC (US) 28037; Carole Autry, P.O. Box 623, Denver, NC (US) 28037

( * ) Notice: Subject to any disclaimer, the term of this patent is extended or adjusted under 35 U.S.C. 154(b) by 0 days.

(21) Appl. No.: 10/271,964

(22) Filed: Oct. 16, 2002

(51) Int. Cl.[7] ..... A41D 27/22
(52) U.S. Cl. ..... 223/94; 223/89
(58) Field of Search ..... 223/88, 94, 89; D6/317

(56) References Cited

U.S. PATENT DOCUMENTS

| | | | | |
|---|---|---|---|---|
| 923,786 A | | 6/1909 | Geraci | |
| 2,491,836 A | * | 12/1949 | Simmet | 223/89 |
| 5,052,599 A | * | 10/1991 | Platti | 223/89 |
| 5,085,358 A | | 2/1992 | Lam | |
| 5,476,199 A | | 12/1995 | Halverson et al. | |
| 5,480,075 A | * | 1/1996 | Robinson | 223/88 |
| 5,711,464 A | | 1/1998 | Huang | |
| 6,003,743 A | | 12/1999 | Deady | |
| 6,164,504 A | | 12/2000 | Richard | |
| 6,179,174 B1 | | 1/2001 | Kandl | |
| 6,206,255 B1 | | 3/2001 | Turner | |
| 6,213,672 B1 | * | 4/2001 | Varga | 403/109.2 |
| 6,220,489 B1 | | 4/2001 | Sato | |

* cited by examiner

*Primary Examiner*—John J. Calvert
*Assistant Examiner*—James G Smith
(74) *Attorney, Agent, or Firm*—John D. Gugliotta; Olen L. York, III

(57) ABSTRACT

An adjustable clothing hanger is a clothes hanger that is adjustable in size. Each side of the hanger has an adjustment mechanism, thus allowing for a variable width. The adjustment mechanism consists of a series of spring loaded pushbuttons (or snap fasteners) on a smaller diameter tube that engages a series of orifices or apertures on a larger diameter tube. It allows for the hanging of larger sized shirts, blouses, jackets, coats and the like without allowing the shoulder sections to sag. The adjustable clothing hanger also provides a swivel joint near the hook of the hanger where it joins the horizontal section. This joint allows the hanger to swivel in the closet and allows the hanger to be at any angle to the closet rod versus the perpendicular manner as required of conventional hangers.

16 Claims, 6 Drawing Sheets

ADJUSTABLE CLOTHES HANGER

RELATED APPLICATIONS

The present invention was first described in Disclosure Document Registration No. 512,395 filed on May 30, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to clothing hangers, and more specifically to an adjustable clothing hanger.

2. Description of the Related Art

Americans are blessed with being able to find virtually any type of clothing style in just about any size. Each person is almost assured of having clothing that fits their body size and shape perfectly. However, with the exception of small child hangers, everyone is forced to store their clothing on a single sized hanger that is approximately 18 inches wide. This is clearly a case where one size does not fit all. Those with larger sized shirts, blouses, jackets, and coats must deal with shoulder areas that sag when stored on a smaller hanger. This causes the clothes to look less than perfect when removed from the hanger and may even necessitate an extra ironing. This of course consumes extra time and ultimately may cause damage to the clothing due to additional ironing, washing, drying or dry cleaning. Accordingly, there exists a need for a means by which those with larger sized clothing can be afforded a means to hang such clothing in a closet without the disadvantages as described above.

A search of the prior art did not disclose any patents that read directly on the claims of the instant invention; however, the following references were considered related:

U. S. Pat. No. 6,220,489, issued in the name of Sato, describes a folding clothes hanger;

U. S. Pat. No. 6,206,255, issued in the name of Turner, describes a clothes hanger adapters;

U. S. Pat. No. 6,179,174, issued in the name of Kandl, describes an adjustable clothes hanger;

U. S. Pat. No. 6,164,504, issued in the name of Richard, describes a clothes hanger extender; which attaches to standard plastic hangers U. S. Pat. No. 6,003,743, issued in the name of Deady, describes a multiple item adjustable clothes hanger for one or more clothing articles;

U. S. Pat. No. 5,711,464, issued in the name of Huang, describes a length adjustable clothes hanger with flexible arm;

U. S. Pat. No. 5,476,199, issued in the name of Halverson et al, describes a clothes hanger with adjustable, extendable clothing support arms;

U. S. Pat. No. 5,085,358, issued in the name of Lam, describes a clothes hanger adjustable in length; and U. S. Pat. No. 923,786, issued in the name of Geraci, describes an adjustable coat hanger.

Consequently, there exists a need for new ideas and enhancements for existing products in the clothing hanger industry.

SUMMARY OF THE INVENTION

It is therefore an object of the present invention to provide an improved adjustable clothing hanger.

It is a feature of the present invention to provide an improved adjustable clothing hanger adjustable to a variety of sizes for accommodating a variety of clothing sizes.

It is a further feature of the present invention to provide an improved adjustable clothing hanger securely impinged so as to prevent unnecessary lateral movement of the device.

It is a further feature of the present invention to provide an improved adjustable clothing hanger having a textured, no-slip surface, thereby preventing slippage of clothes.

Briefly described according to one embodiment of the present invention, an adjustable clothes hanger is a clothes hanger that is adjustable in size. Each side of the hanger has an adjustment mechanism, thus allowing for a variable width. The adjustment mechanism consists of a series of spring loaded pushbuttons (or snap fasteners) on a smaller diameter tube that engages a series of orifices or apertures on a larger diameter tube. It allows for the hanging of larger sized shirts, blouses, jackets, coats and the like without allowing the shoulder sections to sag. Such support eliminates unsightly wrinkles, hanger marks in the yoke of the garment, or the improper stretching of the fabric, and provides for better-looking clothes when they are removed from a closet. The invention also provides a swivel joint near the hook of the hanger where it joins the horizontal section. This joint allows the hanger to swivel in the closet and allows the hanger to be at any angle to the closet rod versus the perpendicular manner as required of conventional hangers. This feature is especially important when used in closets that are not very deep. The use of an adjustable clothes hanger allows those with larger clothing to hang such clothing in a closet, knowing it will be neat, wrinkle-free and presentable when removed.

The use of the present invention provides users with all of the materials and tools necessary to ensure that a user may easily use and maintain an adjustable clothing hanger.

An advantage of the present invention is that it is specifically adapted for personal use because of the light weight components and the use of inexpensive materials.

A further advantage of the present invention is that prevents hanger lines and creases in clothing that are caused by conventional clothing hangers.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1A:
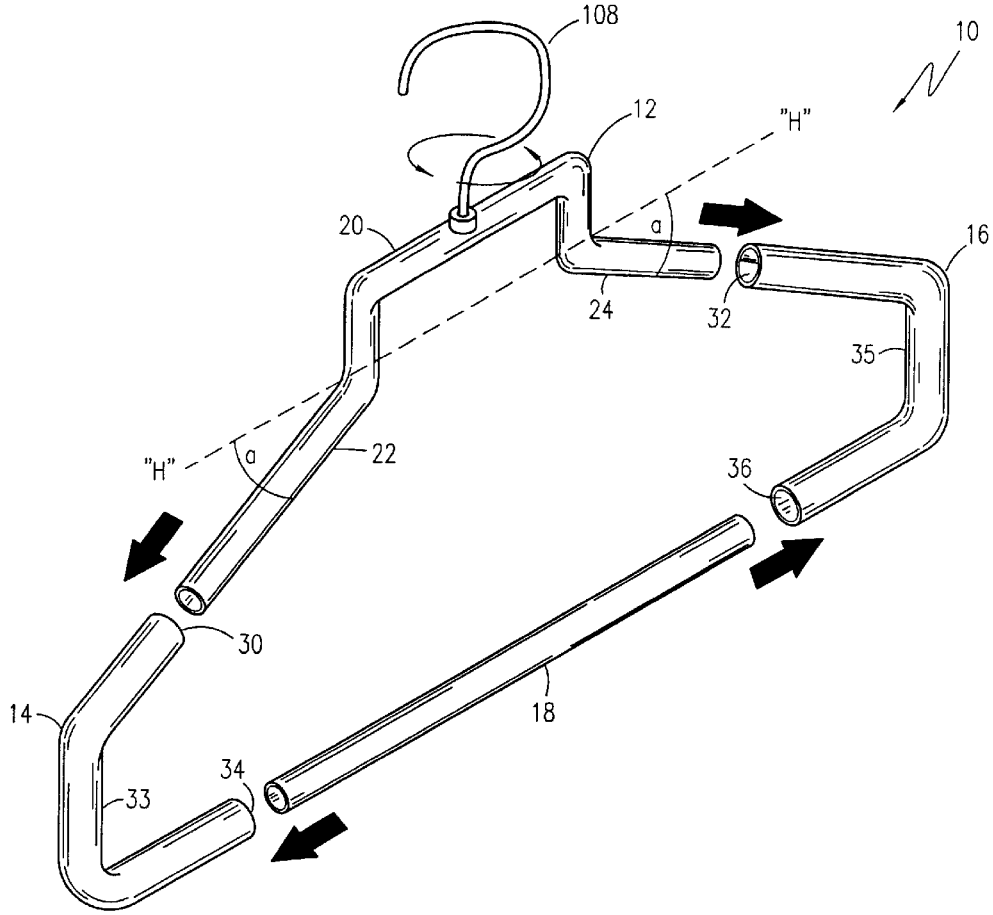
FIG. 1*a* is a perspective view of an adjustable clothing hanger.
Figure 1B:
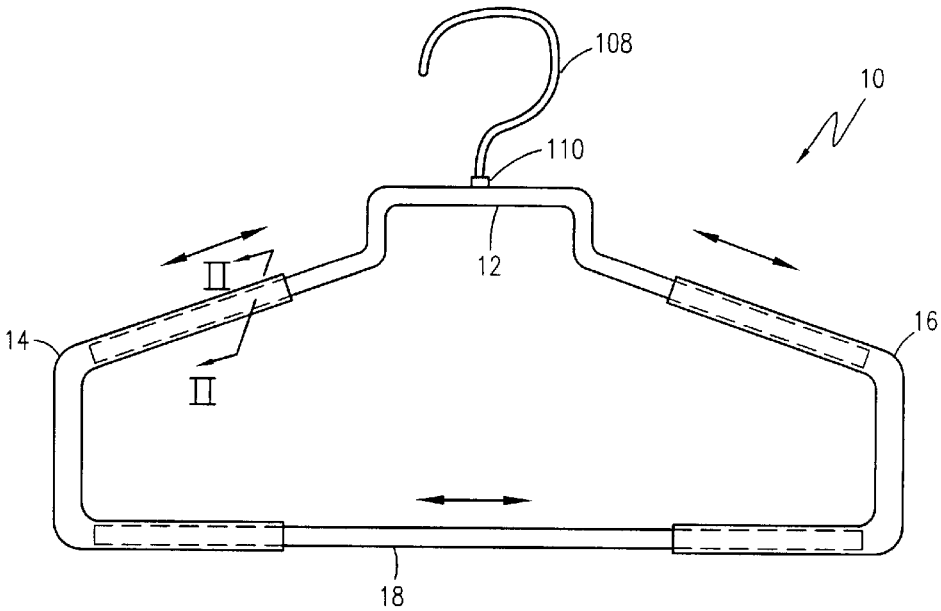
FIG. 1*b* is a side view of the adjustable clothing hanger of FIG. 1*a*.
Figure 2:
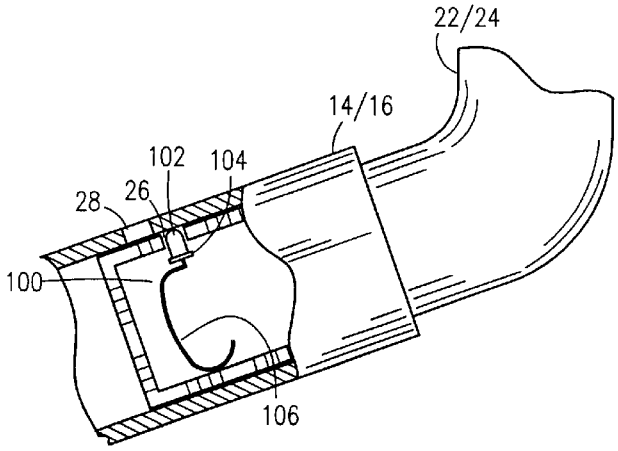
FIG. 2 is an enlarged side view of the inset region of FIG. 1*b*.
Figure 3:
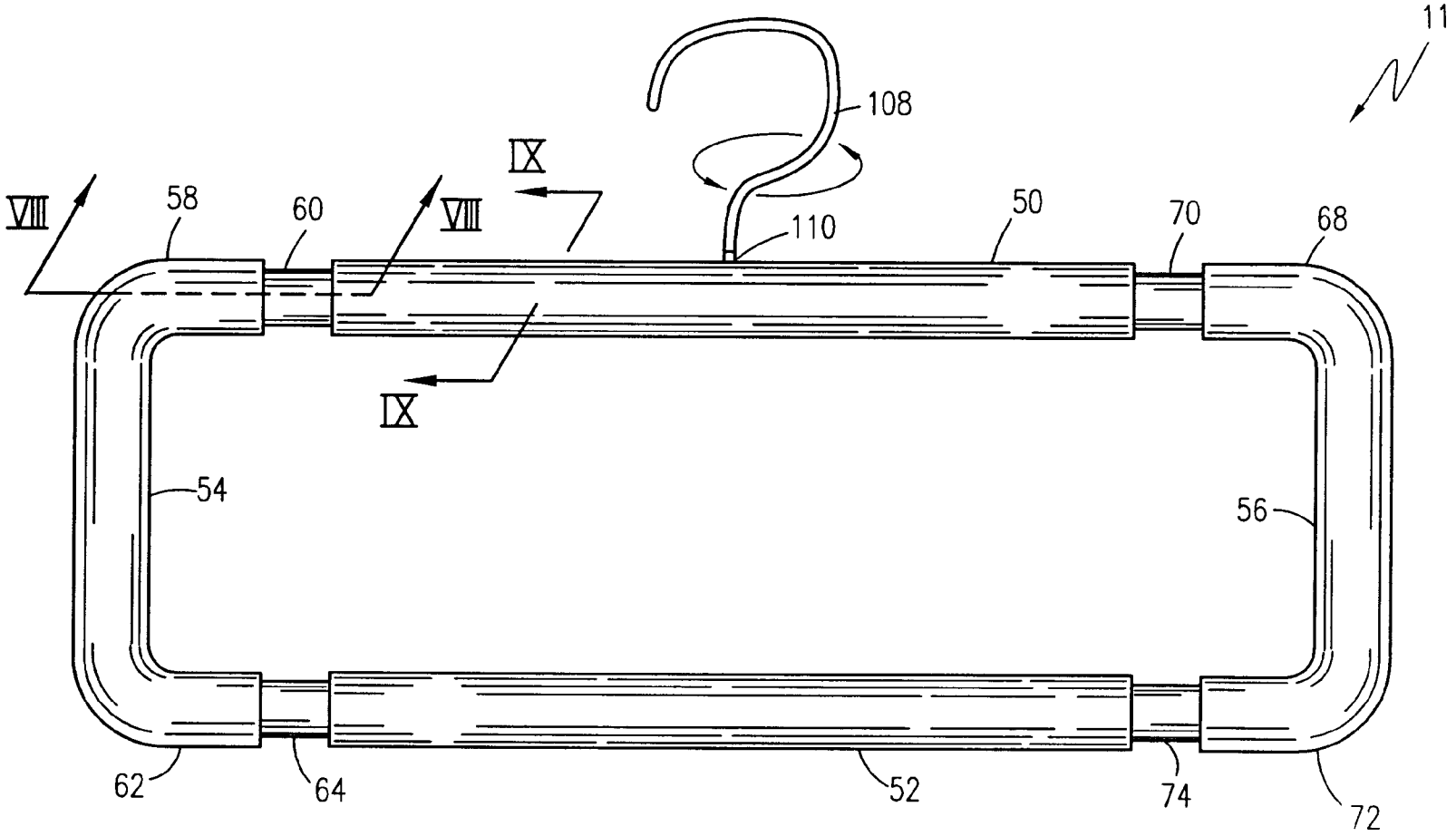
FIG. 3 is a perspective view of an alternative embodiment of the adjustable clothing hanger.
Figure 4:
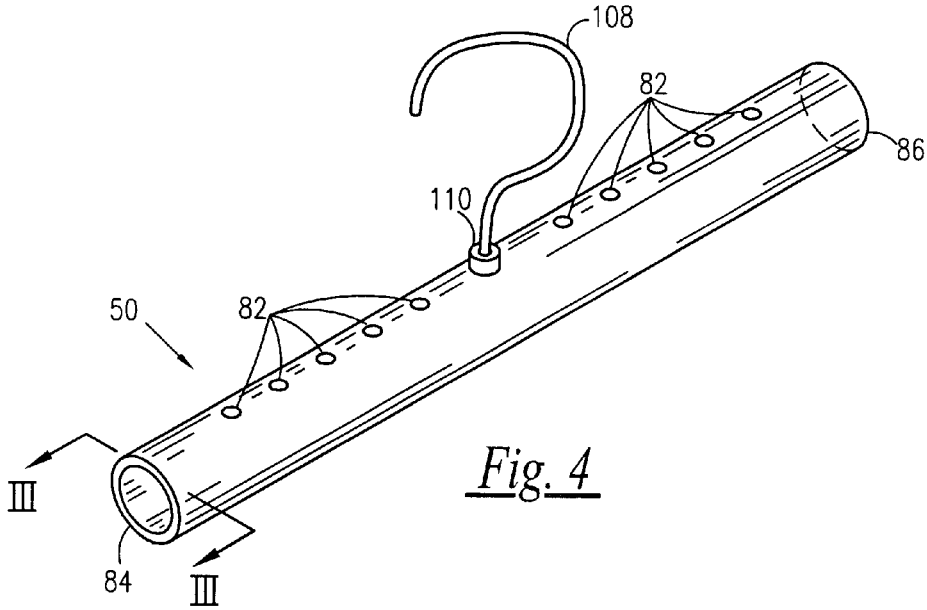
FIG. 4 is a perspective view of an upper conduit of the apparatus of FIG. 3.
Figure 5:
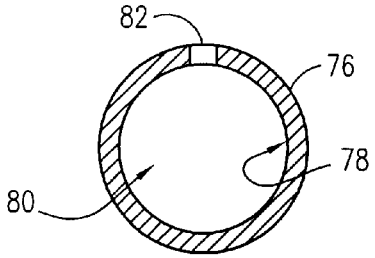
FIG. 5 is a cross-sectional view of the component shown in FIG. 4, taken through line V—V.
Figure 6:
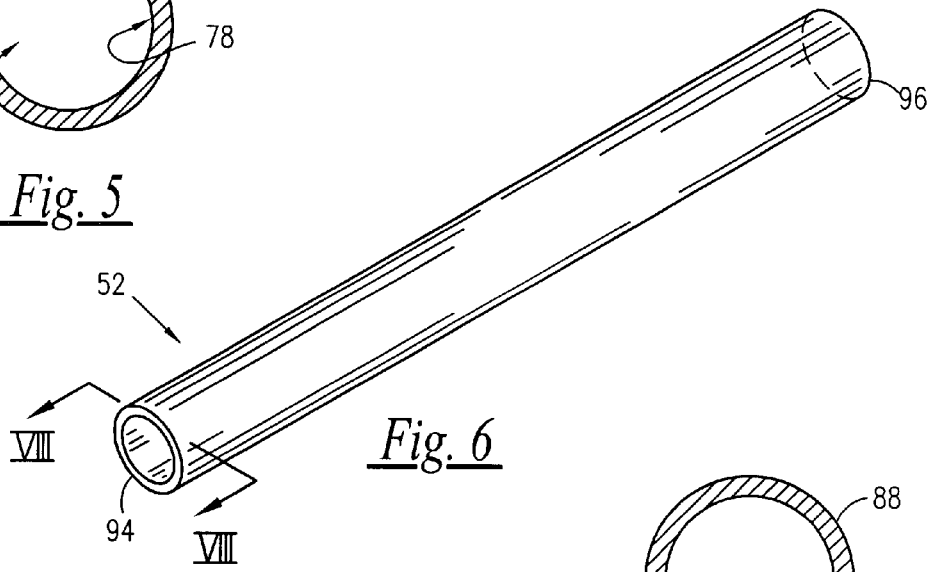
FIG. 6 is a perspective view of a lower conduit of the apparatus of FIG. 3.

Referring now to FIG. 1*a*, FIG. 1*b* and FIG. 2, an adjustable clothing hanger 10, in accordance with the preferred embodiment of the present invention, is shown. The adjustable clothing hanger 10 comprises a yoke 12, a first trap 14, a second trap 16 and a beam 18.

The yoke 12 includes a horizontal top surface 20 with a first pipe 22 depending from a first end of the top surface 20, a second pipe 24 depending from a second end opposite to the first end, and a rotatable hook 108 depending from the center of the top surface 20, thereby providing means for hanging the hanger from a closet rod. The first and second pipes 22 and 24 depend from the top surface 20 at an angle "a" that may vary from 1° to 30° below a horizontal plane indicated by the broken line "H—H". The first pipe 22 telescopes into and out of a first upper cavity 30 of the first trap 14, wherein the first pipe 22 has a smaller cross-sectional diameter than the inner cross-sectional diameter of the first trap 14. Likewise, the second pipe 24 telescopes into and out of a second upper cavity 32 of the second trap 16, wherein the second pipe 24 has a smaller cross-sectional diameter than the inner cross-sectional diameter of the second trap 16. The first and second pipes 22 and 24 each house a spring-urged snap fastener 100 for securely maintaining the hanger at a determined width. The spring-urged snap fastener 100 comprises an impingement head 102 flanked by an impingement boss 104. An outwardly biased spring 106 is affixed to the impingement boss 102. The impingement head 102 penetrates through a lower orifice 26 in the first or second pipe 22 or 24 and then further penetrates through an aligned upper orifice 28 in the first or second trap 14 or 16. Penetration of the impingement head 62 through the lower and upper orifices 26 and 28 securely hold the first or second pipe 22 or 24 in rigid relationship to the first or second trap 14 or 16.

One end of the beam 18 inserts into a first lower cavity 34 of the first trap 14 and the opposing end of the beam 18 into a first lower cavity 36 of the second trap 16. The length of the beam 18 is such that when the hanger 10 is extended to its widest width, the beam 18 will remain housed within the first trap 14 and the second trap 16. The cross-sectional diameter of the shaft is smaller than the inner cross-sectional diameters of the lower cavity 34 of the first trap 14 or the lower cavity 36 of the second trap 16, thereby allowing the beam 18 to telescope as envisioned. The first upper cavity 30 and the first lower cavity 34 are coupled together by a first connecting rod 33. The second upper cavity 32 and the second lower cavity 36 are coupled together by a second connecting rod 35.

Figure 10A:
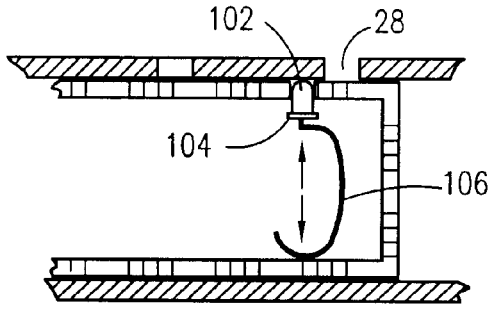
FIG. 10*a* is a cross-sectional view of FIG. 3, taken through line VIII—VIII, wherein a spring urged snap fastener is shown in a retracted stage.
Figure 10B:
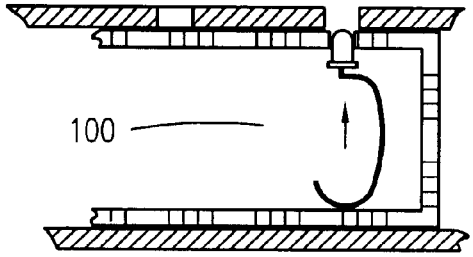
FIG. 10*b* is a cross-sectional view of FIG. 3, taken through line VIII—VIII, wherein the spring urged snap fastener is penetrating a shaft orifice and an aperture.
Figure 10C:
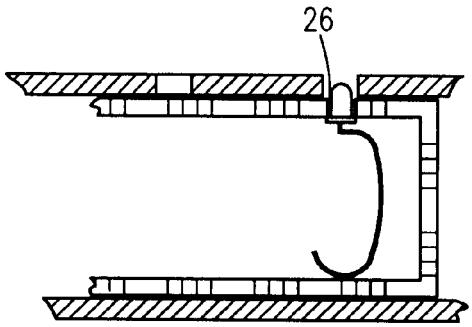
FIG. 10*c* is a cross-sectional view of FIG. 3, taken through line VIII—VIII, wherein the spring urged snap fastener has completely penetrated the shaft orifice and the aperture, thereby impinging movement of the upper conduit in relation to the shaft.

Referring now to FIG. 10*a* through FIG. 10*c*, the spring-urged snap fastener 60 is illustrated and serves as an representative model for inclusion in either the preferred embodiment of FIG. 1*a*, FIG. 1*b* and FIG. 2 or for the alternative embodiment depicted in FIG. 3 through FIG. 9. The first or second pipe 22 or 24 is slidably telescoped within the first or second trap 14 or 16, and the impingement head 62 is compressed within the first or second pipe 22 or 24. When the lower orifice 26 aligns with the upper orifice 28, the outwardly biased spring 66 urges the impingement head 62 outward and upward through the shaft orifice 58 and through the orifices 26 and 28, thereby impinging any further lateral movement of the first or second pipe 22 or 24. To accommodate desired lateral movement and adjustment of the hanger 10, the impingement head 62 is forcibly pressed back into the orifices 26 and 28, respectively, thereby allowing further lateral movement of the first or second pipe 22 or 24.

Referring now to FIG. 3 through FIG. 9, an alternative embodiment of an adjustable clothing hanger 11 is shown. The adjustable clothing hanger 11 comprises a yoke 12, wherein the yoke 12 includes a first trap 14, a second trap 16, a beam 18 and horizontal upper conduit 50. The horizontal upper conduit 50 is opposite to the beam 18. The beam 18 comprises a horizontal lower conduit 52.

The first trap 14 includes a first arm 54 having a first elbow 58 at an end and a second elbow 66 at an opposing end. The first arm 54 includes a first elbow 58. A first shaft 60 depends from the first elbow 58 and telescopes into and out of an end of the upper conduit 50. The first arm 54 further includes a second elbow 62 positioned opposite to the first elbow 58. A second shaft 64 depends from the second elbow 66 and telescopes into and out of an end of the lower conduit 52. The second trap 16 includes a second arm 56 having a third elbow 68 at an end and a fourth elbow 72 at an opposing end. The second arm 56 includes a third elbow 68. A third shaft 70 depends from the third elbow 68 and telescopes into and out of an end of the upper conduit 50. The second arm 56 further includes a fourth elbow 72 positioned opposite to the third elbow 68. A fourth shaft 74 depends from the fourth elbow 72 and telescopes into and out of an end of the lower conduit 52.

Referring now to FIG. 4 through FIG. 7, the upper conduit 50 is a linearly elongated cylinder comprising a curvilinear outer wall 76 and a corresponding curvilinear inner wall 78 forming a hollow internal upper cavity 80 for receiving and housing the first and third shafts 60 and 70. The outer and inner walls 76 and 78 contain a plurality of apertures 82 through which spring-urged snap fastener (discussed in greater detail below) inserts and thereby impinges the lateral movement of the first and third shafts 60 and 70. The upper conduit 50 terminates at two opposing ends 84 and 86 through which the first and third shafts 60 and 70 telescope, respectively. The lower conduit 52 is a linearly elongated cylinder comprising a curvilinear outer wall 88 and a corresponding curvilinear inner wall 90 forming a hollow internal lower cavity 92 for receiving and housing the second and fourth shafts 64 and 74. The lower conduit 52 terminates at two opposing ends 94 and 96 through which the second and fourth shafts 64 and 74 telescope, respectively.

Figure 7:
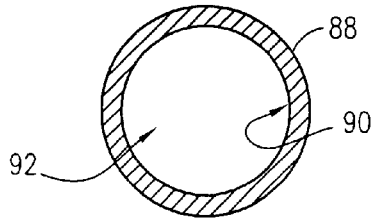
FIG. 7 is a cross-sectional view of the component shown in FIG. 6, taken through line VII—VII.
Figure 8:
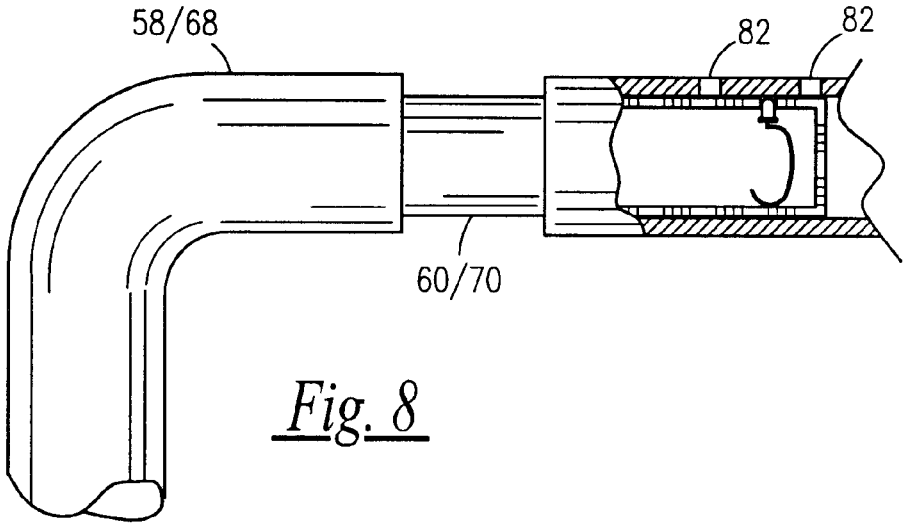
FIG. 8 is a side view and partial cross-section, wherein a portion of the upper conduit is pulled back so as to see the relationship between the upper conduit and the telescoping shaft, taken through the line VIII—VIII of FIG. 3.
Figure 9:
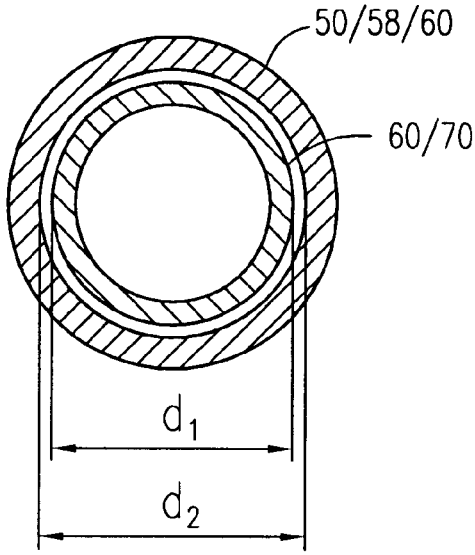
FIG. 9 is a cross-sectional view of FIG. 3, taken through line IX—IX, wherein the diameter of the telescoping shaft is illustrated in relationship to the internal diameter of the upper conduit.

Referring now to FIG. 8, the first and third shafts 60 and 70 are identical in structure and function, therefore a description of the first shaft 60 will serve as a representative description of the third shaft 70. The first shaft 60 is a linearly elongated member projecting from the first elbow 58, wherein the first shaft 60 is affixed to the first elbow 58 in a rigid manner. The first shaft 60 has a tubular construction (as seen in FIG. 7). The first shaft 60 has a smaller cross-sectional diameter "$d_1$" than the internal cross-sectional diameter "$d_2$" of either the first elbow 58 or the upper conduit 50, thereby allowing for the lateral telescoping movement necessary for the hanger 11 to expand or contract in size. Likewise, the third shaft 70 is a linearly elongated member projecting from the third elbow 68, wherein the third shaft 70 is affixed to the third elbow 68 in a rigid manner. The third shaft 70 has a tubular construction. The third shaft 70 has a smaller cross-sectional diameter "$d_1$" than the internal cross-sectional diameter "$d_2$" of either the third elbow 68 or the upper conduit 50, thereby allowing for the lateral telescoping movement necessary for the hanger 11 to expand or contract in size.

The first and third shafts 60 and 70 each further include a shaft orifice 98 that allows a spring-urged snap fastener 100 to penetrate through and into an aperture 102, thereby securely impinging the first and third shafts 60 and 70 once a desired hanger 11 size has been determined. The spring-urged snap fastener 100 comprises an impingement head 102 flanked by an impingement boss 104. An outwardly biased spring 106 is affixed to the impingement boss 102. As best shown in FIG. 10*a* through FIG. 10*c*, the first or third shaft 60 or 70 is slidably telescoped within the upper conduit 50, and the impingement head 102 is compressed within the shaft orifice 98 by the inner wall 78 of the upper conduit 50. When an aperture 82 is aligned with a shaft orifice 98, the outwardly biased spring 106 urges the impingement head 102 outward and upward through the shaft orifice 98 and through the aperture 82, thereby impinging any further lateral movement of the first or third shaft 60 or 70. To accommodate desired lateral movement and adjustment of the hanger 11, the impingement head 102 is forcibly pressed back into the aperture 82 and the shaft orifice 98, respectively, thereby allowing further lateral movement of the first or third shaft 60 or 70.

The second and fourth shafts 64 and 74 are identical in structure and function, therefore a description of the second shaft 64 will serve as a representative description of the fourth shaft 74. The second shaft 64 is a linearly elongated member projecting from the second elbow 62, wherein the second shaft 64 is affixed to the second elbow 62 in a rigid manner. The second shaft 64 may have a tubular construction or a solid body construction. The second shaft 64 has a smaller cross-sectional diameter "d1" than the cross-sectional diameter "d2" of either the second elbow 62 or the lower conduit 52, thereby allowing for the lateral telescoping movement necessary for the hanger 11 to expand or contract in size. Likewise, the fourth shaft 74 is a linearly elongated member projecting from the fourth elbow 72, wherein the fourth shaft 74 is affixed to the fourth elbow 72 in a rigid manner. The fourth shaft 74 has a tubular construction or a solid body construction. The fourth shaft 74 has a smaller cross-sectional diameter "$d_1$" than the internal cross-sectional diameter "$d_2$" of either the fourth elbow 72 or the lower conduit 52, thereby allowing for the lateral telescoping movement necessary for the hanger 11 to expand or contract in size. As the first and third shafts 60 and 70 are telescopically expanded or retracted, the second and fourth shafts 64 and 74 telescopically expand and retract in reaction to the telescopic movement. Thus, the first, second, third and fourth shafts 60, 64, 70 and 74 move in unison to a desired size chosen by a user. Further, the second and fourth shafts 64 and 74 are of sufficient length so as not to fall out of the lower conduit 52 when the hanger 11 is extended to its widest length.

Referring back to FIG. 1, a rotatable hook 108 is affixed to the upper conduit 50 and positioned between the medial apertures 82'. The hook 108 is affixed to the upper conduit 50 by a spindle 110, in which the hook 108 and spindle 110 are rotatable through 360° of motion.

The hanger 10 or 11 may be manufactured from a number of substances, including recyclable materials such as plastic, metal or wood. The hanger 10 or 11 is envisioned to be available in a variety of solid colors or multi-colors. The shaft 18 or the lower conduit 52 may also include a textured outer wall so as to better hold trousers, slacks, linens or other similar items that might be draped over the shaft 18 or lower conduit 52.

In either embodiment, it is envisioned that two general types of hanger 10 will be available; a child size and an adult size. The dimensions of the child hanger will narrow to ten (10) inches and extend out to sixteen (16) inches. The dimensions of the adult hanger will narrow to sixteen (16) inches and extend out to twenty-six (26) inches.

It is envisioned that other styles and configurations of the present invention can be easily incorporated into the teachings of the present invention, and only one particular configuration shall be shown and described for purposes of clarity and disclosure and not by way of limitation of the scope.

2. Operation of the Preferred Embodiment

The hanger 10 is adjustable to adopt a variety of sizes. To adjust the size of the hanger 10, a user will press the protruding impingement head 102 back into and through the orifices 26 and 28, thereby freeing the first or second pipe 22 or 24 to laterally telescope into or out of the first or second trap 14 or 16 and their respective upper cavities 30 or 32. If desired, the remaining pipe 22 or 24 may be freed by pressing the remaining impingement head 102 back into and through the orifices 26 and 28, thereby freeing the remaining first or second pipe 22 or 24 to laterally telescope into or out of the remaining first or second trap 14 or 16. As the first or second pipe 22 or 24 is laterally telescoped, the shaft 18 telescopes in the same manner with the lower cavity 34 of the first trap 14 and the lower cavity 36 of the second trap 16.

After determining the appropriate size for the hanger 10, a user will place a clothing garment onto the hanger 10. If the hanger 10 needs to be adjusted, the user can simply locate and press the impingement head(s) 102 thereby releasing the first or second pipe 22 or 24 for further telescopic movement. The user may then place the hanger 10 onto a closet rod by the hanger hook 108.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An adjustable clothing hanger comprising:

a yoke, having a horizontal top surface, a first pipe depending from an end of said top surface at an angle between 1° and 30° below a horizontal plane, and a second pipe depending from an opposing end of said top surface at an angle between 1° and 30° below said horizontal plane;

a linearly elongated beam, said beam terminating at two opposing ends, said beam opposite to said yoke;

a first trap wherein, said yoke physically communicating with an end of said first trap for telescopic movement therein and, said beam physically communicating with an opposing end of said first trap for telescopic movement therein;

a second trap wherein, said yoke physically communication with an end of said second trap for telescopic movement therein and, said beam physically communicating with an opposing end of said second trap for telescopic movement therein; and a rotatable hook, depending from said yoke, thereby providing means for suspending said hanger from a closet rod.

2. The adjustable clothing hanger of claim 1, wherein said first pipe and said second pipe each comprise a spring-urged snap fastener for securely maintaining said hanger at a determined lateral width.

3. The adjustable clothing hanger of claim 2, wherein said first pipe and said second pipe each comprise a lower orifice, said lower orifice accommodating said spring-urged snap fastener.

4. The adjustable clothing hanger of claim 3, wherein said first trap and said second trap each comprise a plurality of upper orifices, said plurality of upper orifices aligning with said lower orifices, thereby accommodating said spring-urged snap fastener.

5. The adjustable clothing hanger of claim 4, wherein said spring-urged snap fastener comprises:

an impingement head;

an impingement boss affixed to a flank of said impingement head;

an outwardly biased spring affixed to said impingement boss;

said impingement head penetrates said lower orifice and said upper orifice, thereby securely maintaining a rigid relationship between said first pipe and said first trap and between said second pipe and said second trap.

6. The adjustable clothing hanger of claim 5, wherein said first trap further comprises:

a first upper cavity, receiving said first pipe;

a first lower cavity opposite said first upper cavity, said first lower cavity receiving an end of said beam;

a first connecting rod wherein, said first upper cavity affixed to an end of first connecting rod, said first lower cavity affixed to an opposite end of first connecting rod.

7. The adjustable hanger of claim 6, wherein said second trap further comprises:

a second upper cavity, receiving said second pipe;

a second lower cavity opposite said second upper cavity, said second lower cavity receiving an end of said beam;

a second connecting rod wherein, said second upper cavity affixed to an end of second connecting rod, said second lower cavity affixed to an opposite end of second connecting rod.

8. The adjustable hanger of claim 1, wherein said beam has a length longer than a widest lateral width of said hanger, thereby allowing said beam to remain within said first trap and said second trap.

9. The adjustable hanger of claim 1, wherein said yoke is a linearly elongated upper conduit terminating at two opposing ends and comprising:

a curvilinear outer wall;

a curvilinear inner wall housed within said outer wall;

a hollow internal upper cavity formed by said outer wall and said inner wall, said hollow internal upper cavity receiving a first shaft of a first arm and a third shaft of a second arm; and a plurality of apertures, accommodating spring-urged snap fasteners.

10. The adjustable clothing hanger of claim 9, wherein said beam is a lower conduit comprising:

a curvilinear outer wall;

a curvilinear inner wall housed within said outer wall; and a hollow internal lower cavity formed by said outer wall and said inner wall, said hollow internal lower cavity receiving a second shaft of a first arm and a fourth shaft of a second arm.

11. The adjustable clothing hanger of claim 10, wherein said first trap comprises:

a first arm;

a first elbow, depending from an end of said first arm;

a first shaft, depending from said first elbow, said first shaft telescopically communicating with an end of said hollow internal upper cavity;

a second elbow, depending from an opposing end of said first arm;

a second shaft, depending from said second elbow, said second shaft telescopically communicating with an opposing end of said hollow internal upper cavity.

12. The adjustable clothing hanger of claim 11, where said second trap comprises:

a second arm;

a third elbow, depending from an end of said second arm;

a third shaft, depending from said third elbow, said third shaft telescopically communicating with an end of said hollow internal upper cavity;

a fourth elbow, depending from an opposing end of said second arm;

a fourth shaft, depending from said fourth elbow, said fourth shaft telescopically communicating with an opposing end of said hollow internal upper cavity.

13. The adjustable clothing hanger of claim 12, wherein said first shaft and said third shaft each comprise a shaft orifice, each said shaft orifice accommodating said spring-urged snap fastener.

14. The adjustable clothing hanger of claim 13, wherein one of said shaft orifices aligns with one of said plurality of apertures, thereby accommodating said spring-urged snap fastener.

15. The adjustable clothing hanger of claim 14, wherein said spring-urged snap fastener comprises:

an impingement head;

an impingement boss, affixed to a flank of said impingement head;

an outwardly biased spring, affixed to said impingement boss; said impingement head penetrates said shaft orifice and said aperture, thereby securely maintaining a rigid relationship between said first shaft and said upper conduit and between said third shaft and said upper conduit.

16. The adjustable clothing hanger of claim 15, wherein said second shaft and said fourth shaft each have a smaller cross-sectional diameter than an internal cross-sectional diameter of said lower conduit, thereby allowing lateral telescopic movement of said second shaft and said fourth shaft.

* * * * *